US010030296B2

(12) United States Patent
Arnaboldi et al.

(10) Patent No.: US 10,030,296 B2
(45) Date of Patent: Jul. 24, 2018

(54) DISCOLORATION-RESISTANT GOLD ALLOY

(71) Applicant: ARGOR-HERAEUS SA, Mendrisio (CH)

(72) Inventors: Sergio Arnaboldi, Suello (IT); Marco Nauer, Morbio Inferiore (CH); Stefano Ghiringhelli, Luisago Como (IT)

(73) Assignee: ARGOR-HERAEUS SA, Mendrisio (CH)

( * ) Notice: Subject to any disclaimer, the term of this patent is extended or adjusted under 35 U.S.C. 154(b) by 0 days.

(21) Appl. No.: 14/649,502

(22) PCT Filed: Dec. 2, 2013

(86) PCT No.: PCT/IB2013/002683

§ 371 (c)(1),
(2) Date: Jun. 3, 2015

(87) PCT Pub. No.: WO2014/087216

PCT Pub. Date: Jun. 12, 2014

(65) Prior Publication Data

US 2015/0345001 A1 Dec. 3, 2015

(30) Foreign Application Priority Data

Dec. 3, 2012 (IT) ..... RN2012A0608

(51) Int. Cl.
*C22C 5/02* (2006.01)
*C22F 1/14* (2006.01)
(Continued)

(52) U.S. Cl.
CPC ..... *C22F 1/14* (2013.01); *C22C 1/02* (2013.01); *C22C 5/02* (2013.01); *C22F 1/002* (2013.01); *C22F 1/02* (2013.01)

(58) Field of Classification Search
CPC .... C22F 1/14; C22F 1/002; C22F 1/02; C22C 1/02; C22C 5/02
See application file for complete search history.

(56) References Cited

U.S. PATENT DOCUMENTS 4,820,487 A 4/1989 Antoniazzi
7,413,705 B2 8/2008 Agarwal et al.

FOREIGN PATENT DOCUMENTS

CA 2 670 604 1/2011
DE 3211703 10/1983
(Continued)

OTHER PUBLICATIONS

Peter Spiekermann, "Legierungen—ein besonderes patentrechtliches Problem?", XP000961882, 1993, pp. 178-190.
(Continued)

*Primary Examiner* — Colleen P Dunn
*Assistant Examiner* — Anthony M Liang
(74) *Attorney, Agent, or Firm* — Steinfl + Bruno LLP

(57) ABSTRACT

Alloy for the manufacturing of jewels or clock components with minimum concentrations of gold of 75 wt %, of copper between 5% and 21%, of silver between 0% and 21%, of iron between 0.5% and 4% and vanadium between 0.1% and 2.0%, intended to increase the tarnishing-resistance of alloys with a minimum content of gold of 75 wt % under environments in which sulphur- and chlorine-compounds are present.

3 Claims, 8 Drawing Sheets

(51) Int. Cl.

| | |
|---|---|
| ***C22C 1/02*** | (2006.01) |
| ***C22F 1/00*** | (2006.01) |
| ***C22F 1/02*** | (2006.01) |

(56) References Cited

FOREIGN PATENT DOCUMENTS

| | | | | | |
|---|---|---|---|---|---|
| DE | 19958800 | A1 | * | 1/2001 | ..... C22C 5/02 |
| DE | 100 27 605 | | | 12/2001 | |
| DE | 10 2004 050 594 | | | 6/2005 | |
| EP | 0 381 994 | | | 8/1990 | |
| EP | 0 904 765 | | | 3/1999 | |
| EP | 0904765 | | * | 3/1999 | |
| EP | 1 227 166 | | | 7/2002 | |
| EP | 1 512 765 | | | 3/2005 | |
| EP | 2 251 444 | | | 11/2010 | |
| GB | 2 279 662 | | | 1/1995 | |
| JP | 60-258435 | | | 12/1985 | |
| JP | 63-24050 | | | 2/1988 | |
| JP | 4-193924 | | | 7/1992 | |
| JP | 04193924 | A | * | 7/1992 | ..... C22C 5/02 |
| JP | 0967628 | A | * | 3/1997 | |
| JP | 10245646 | | | 9/1998 | |
| JP | 2001-335861 | | | 12/2001 | |
| JP | 2002-105558 | | | 4/2002 | |
| JP | 2005-082890 | | | 3/2005 | |
| JP | 2008-179890 | | | 8/2008 | |
| JP | 2008-308757 | | | 12/2008 | |
| JP | 2009-228088 | | | 10/2009 | |
| WO | 2009/092920 | | | 7/2009 | |

OTHER PUBLICATIONS

E. Suoninen et al, "Effect of Palladium on Sulfide Tarnishing of Noble Metal Alloys", Journal of Biomedical Materials Research, vol. 19, 917-934 (1985).

M. Ohta et al., "Effect of Palladium Addition on the Tarnishing of Dental Gold Alloys", Journal of Materials Science: Materials in Medicine 1 (1990), pp. 140-145.

Rapson, W.S. "Tarnish Resistance, Corrosion and Stress Corrosion Cracking of Gold Alloys" Gold Bulletin; 1996; 29(2); pp. 61-69.

Treacy, D. et al. "Chemical Stability of Gold Dental Alloys" Gold Bulletin; 1984; 17(2); pp. 46-54.

* cited by examiner

DISCOLORATION-RESISTANT GOLD ALLOY

CROSS RELATED APPLICATION

This application is the U.S. national phase of International Application No. PCT/IB2013/002683 filed 2 Dec. 2013 which designated the U.S. and claims priority to Italian Patent Application No. RM2012A000608 filed 3 Dec 2012, the entire contents these applications are incorporated by reference.

DESCRIPTION

FIELD OF THE ART

The present invention relates to an alloy for the manufacturing of jewels and/or clock components and/or the like with gold at a minimum concentration of 75 wt %, copper at a concentration of between 5 wt % and 21 wt %, silver at a concentration of between 0 wt % and 21 wt %, iron at a concentration of between 0.5 wt % and 4 wt %, vanadium at a concentration of between 0.1 wt % and 2.0 wt %, and iridium at a concentration of between 0 wt % and 0.05 wt %. In a particular embodiment of the invention, the alloy comprises palladium in contents ranging from 0.5 wt % to 4 wt %.

STATE OF THE ART

Due to its high ductility, excellent thermal and electrical conductivity or high chemical inertness, gold has always been used in different application fields and whenever these properties serve for major technological functions. Particularly, the unique optical and color properties of this element have been exploited since antiquity for the manufacturing of decorative objects.

Over the past few years, many gold alloys with defined functional properties have also been developed. Even today, many of the studies focusing on gold alloys are aimed at identifying particular, new chemical compositions which can meet the increasingly diverse requirements of clock-making industry or jewelry manufacturers. In fact, increasingly specific demands in the industrial field have made indispensable the synthesis of compositions with innovative color properties. The color of a generic metal alloy is strictly dependent on its chemical composition because the mechanisms of interaction between the incident light and the metal are a function of both the alloying elements and the contents in which they are present within the alloy. For example, gold alloys with shades varying from green to yellow or rose (colored gold alloys) typically contain silver and copper, whereas elements such as palladium, platinum, nickel or manganese are added to gold for the production of white alloys.

Due to recent developments in spectrophotometric techniques, the color of a generic metal can be quantitatively and uniquely defined in the three-dimensional domain CIE 1976 L*a*b* once the values of the Cartesian coordinates L*, a* and b* are known (standard ISO 7224). The parameter L* identifies the brightness and takes values ranging from 0 (black) to 100 (white), whereas a* and b* are the chrominance coordinates. Therefore, in this space, the achromatic grayscale is identified by points on the axis L* where a*=b*=0, whereas a* and b* identify the color. Positive a* values denote red, negative a* values denote green, positive b* values denote yellow, and negative b* values denote blue.

Furthermore, this color evaluation system can provide an estimate for the difference $\Delta E^*(L^*,a^*,b^*)=(\Delta L^{*2}+\Delta a^{*2}+\Delta b^{*2})^{1/2}$ between two different shades of color. $\Delta L^*$, $\Delta a^*$ and $\Delta b^*$ represent the arithmetic differences between the values of the coordinates L*,a*,b* identifying the two given shades in the space CIE 1976 L*a*b*. Generally, human eye is able to distinguish between two different shades of color if $\Delta E^*(L^*,a^*,b^*)\geq 1$.

Gold alloys may undergo unwanted surface discolorations over time as a result of chemical/physical interactions which can occur between the metal and aggressive environments capable to promote phenomena of corrosion or tarnishing. According to the literature ("Tarnish resistance, corrosion and stress corrosion cracking of gold alloys"; Gold Bulletin, 29(2) pp 61-68, 1996; "Chemical stability of Gold dental alloys"; Gold Bulletin, 17(2), pp 46-54, 1984), the phenomenon of corrosion is defined as a gradual chemical or electrochemical attack which can then result in a continuous dissolution of metal. Differently, the phenomenon of tarnishing is a specific form of corrosion. In this case, the reactions accompanying this phenomenon lead to the formation of thin layers of oxides, sulphides or chlorides which can alter the color and the surface gloss of gold alloys. These changes in surface color properties can be quantified by evaluating the parameter $\Delta E(L^*,a^*,b^*)$ over time, as calculated with respect to the conditions before the onset of corrosion phenomena.

18-carat gold alloys are traditionally considered not susceptible to corrosion phenomena, thus being suitable for the manufacturing of jewels or clock components. Indeed, recent studies and observations do not seem to confirm these considerations as they show that even high contents of gold or other noble elements do not ensure an adequate chemical stability over time under different conditions of use.

For example, a standard 18-carat alloy 5N ISO 8654 containing copper in a content of 20.5% and silver in a content of 4.5 wt % shows an apparent chemical instability even when subjected only to the action of a generic ambient atmosphere. At a temperature of 25° C., the interactions occurring between the metal and the ambient atmosphere can alter the surface color of the given gold alloy. These color changes are a function of the time t of exposure to the aggressive action of the atmosphere environment, and they can be quantified by spectrophotometrically measuring the values of the coordinates L*, a*, b* on the surface of a sample of a 18-carat alloy 5N ISO 8654. The values of the CIE 1976 coordinates L*a* b*as measured at defined time intervals allow the kinetics of surface discoloration of the test sample to be analyzed by evaluating the parameter $\Delta E^*(L^*,a^*,b^*)=[(L^*-L^*_0)^2+(a^*-a^*_0)^2+(b^*-b^*_0{}^2)]^{1/2}$ over time. This parameter is calculated with respect to the coordinates $L^*_0$, $a^*_0$, $b^*_0$ of the test alloy as measured immediately after smoothing and subsequent polishing of the surface of the test sample. This surface processing of the sample is performed until a constant reflection factor is achieved. Such a surface processing of the test sample is essential, and it is carried out in order to remove traces of any compound (e.g. oxides) which can alter the surface composition of the alloy and its actual color, thereby having the potential to distort the experimental measurements. The results of these tests allow obtaining experimental curves $\Delta E^*(L^*,a^*,b^*)$ vs. time, as shown in FIG. 1. The curve shown herein can then be analyzed. Since time t=0 corresponds to the conditions immediately after polishing, then the value of $\Delta E^*(L^*,a^*,b^*,t=0)$ is zero. The value of this parameter tends to vary widely during the early days of the test. In fact, after about 5 days from the start of the test, the material undergoes a perceptible color change $\Delta E^*(L^*,a^*,b^*) \geq 1$. Beyond this time interval, the value of the parameter $\Delta E^*(L^*,a^*,b^*)$ continues to increase but the rate at which the color varies over time decreases, until the parameter $\Delta E^*(L^*,a^*,b^*)$ almost asymptotically reaches a plateau of values of less than 2.5.

The manner in which corrosion phenomena occur in gold alloys is closely related to the composition of alloys. With increased levels of silver, copper or other elements capable of degrading the typical chemical stability of gold, the chances of initiating corrosion phenomena of different nature increase. Similarly, the kinetics of the chemical or electrochemical reactions accompanying the alteration in surface properties of the manufactured articles will be also favored.

The manner in which the tarnishing or corrosion phenomena occur may also be related to microstructural features of gold alloys. From a metallurgical point of view, any microstructural inhomogeneity can generate differences in electrical potential within the material, thereby decreasing its chemical stability. For this reason, homogeneous solid solutions generally have an increased chemical stability against corrosion compared to alloys whose microstructures are formed by either multiple immiscible phases or different structural components. In addition, grain boundaries may constitute preferential sites of initiation for corrosion phenomena. The size of the crystal grain (standard ISO 643) influences the chemical stability of a gold alloy because the average size of crystal grains is inversely proportional to the energy of grain boundary. This energy, which is defined as the free energy of the polycrystalline structure in excess to that of the perfect lattice, can cause a decrease in chemical stability of the alloy, thereby increasing the electrochemical potential differences established between either the alloying elements or the segregated phases. Eventually, the presence of any residual stress generated by the volume shrinkage of the material during solidification or cold plastic deformation processing, can give rise to phenomena of stress corrosion and lead to undesired fractures in the material.

The environments capable of promoting corrosion in gold alloys are multiple, and they are related to the applications of the alloys. In the jewelry and clock-making industries, colored alloys containing silver or copper appear to be particularly susceptible to tarnishing phenomena. Both chloride-containing solutions, such as seawater, and surfactant-containing solutions can initiate undesired changes in surface color of this type of gold alloys within a short time. Similarly, moisture, organic vapors, oxygen compounds and especially sulphur compounds, such as hydrogen sulphide $H_2S$, existing in the environmental atmosphere, are also able to initiate tarnishing phenomena. Eventually, the same problems may arise from the interaction with organic solutions such as sweat, in which salts such as sodium chloride, electrolytes, fatty acids, uric acid, ammonia and urea are primarily dissolved.

Therefore, colored gold alloys, which are characterized by shades ranging from green to yellow or rose and which are typically employed for the manufacturing of jewels or clock components, can distinctively show an inadequate chemical stability and undergo unwanted changes in surface color properties over time. The present invention seeks to improve the chemical stability of currently commercially available colored gold alloys. Particularly, the aim is to increase the tarnishing-resistance of alloys containing gold in a minimum content of 75 wt % under environments in which sulphur- or chlorine-compounds are present.

Technical literature discloses several chemical compositions in which elements such as germanium, indium, cobalt, gallium, manganese, zinc, tin or iron are added to the basic ternary gold-silver-copper system in order to obtain particular physical or functional properties. The compositions shown below are all expressed as percentages by weight.

Document JP2008179890A (2008) considers germanium as an element which can increase the corrosion-resistance of 18-carat gold alloys. Particularly, compositions with contents of germanium in a range from 0.01% to 10% are envisaged.

Document JP2002105558A (2002) also discloses concentrations of germanium in a range from 3% to 5% in compositions characterized by at least 75% of gold, contents of copper between 12% and 13%, and silver to balance. In this case, germanium is not considered to improve the chemical stability of 18-carat rose alloys, but only to achieve desired color properties.

Document CA2670604A1 (2011) discloses compositions comprising gold in a content between 33.3% and 83%, indium in a content between 0.67% and 4.67%, tin in a content up to 0.9%, manganese in a content up to 0.42%, silicon in a content up to 0.04%, and copper to balance. In this case, indium is used to obtain gold alloys with colors similar to those of bronzes.

On the other hand, document U.S. Pat. No. 7,413,505 (2008) proposes 14-carat rose gold alloys in which, in addition to copper, silver and zinc, cobalt in contents between 3% and 4% is added to the alloy in order to achieve specific values of hardness. The same document discloses similar 18-carat alloys whose compositions are, however, not claimed.

In order to obtain improved hardness and corrosion-resistance compared to those of standard alloys employed in dentistry, document JP2009228088A (2009) proposes the addition of gallium in a range between 0.5% and 6% to gold alloys characterized by comprising gold in a content greater than 75%, platinum in a content between 0.5% and 6%, palladium in a content between 0.5% and 6%, and copper to balance.

Instead, document JP2001335861 (2001) claims the addition of manganese in contents between 2% and 10% to alloys comprising gold in a minimum content of 75%, copper in a content between 10% and 30%, silver in a content between 0.5% and 3%, zinc in a content between 0.5% and 3%, and indium in a content between 0.2 and 2%.

Eventually, document GB227966A (1985) discloses alloys comprising gold in a content between 33% and 90%, iron in a content between 0.1% and 2.5%, silver in a content between 0.01% and 62.5%, copper in a content between 0.01% and 62.5%, zinc in a content between 0.01% and 25%, and characterized by hardness values in a range from 100 HV to 280 HV.

Still further, document JP2008308757 (2008) considers the addition of 0.5%-5% of tin to gold alloys containing copper in a content between 14.5% and 36.5% and indium in a content between 0.5% and 6%. In this case, the invention only claims that rose gold alloys can be obtained while avoiding the use of elements such as nickel, manganese and palladium and the disadvantages resulting from their use. In fact, as it is known, nickel can cause allergies, manganese in addition to decrease cold plastic deformation processability, requires require the use of advanced manufacturing technologies, and palladium reduces surface brightness.

As previously stated, palladium is an element which is typically added to gold for the synthesis of white alloys. Certain documents report the use of this chemical element also in colored gold alloys because, even if it generates dark, low-glossy surfaces, it can effectively increase the resistance against corrosion phenomena.

In fact, even palladium contents of less than 3 wt % ("Effect of palladium addition on the tarnishing of dental gold alloys"; J. Mater. Sci.-Mater., 1(3), pp. 140-145, 1990; "Effect of palladium on sulfide tarnishing of noble metal alloys"; J. Biomed. Mater. Res., 19(8), pp. 317-934, 1985) minimize the tarnishing effects generated by environments in which sulphur compounds are especially, present. In this case, palladium can reduce the growth of the surface layer mainly consisting of silver sulphide ($Ag_2S$). Contrary to what happens with silver, a surface enrichment of palladium doesn't occur, but it is possible to observe a statistical increase in the content of such an element in the layer immediately below the outermost layer of sulphides. This localized increase in palladium reduces the diffusion of $S^{2-}$ ions from the surface region to the core of the manufactured articles, thereby consequently decreasing the growth of the layer of sulphides and the change in surface color of the gold alloys containing it.

For example, document JP60258435A (1985) considers palladium as an element capable of improving the chemical stability of 18-carat gold alloys characterized by comprising copper in a content between 15% and 30% and silver in a content between 5% and 25%. In this case, the invention discloses additions of palladium in a range from 4% to 7%.

Document JP10245646A (1998) also proposes additions of palladium in a range between 0.3% and 5% to rose gold alloys (L*=86÷87, a*=, 8÷10 a* and b*=17÷22) comprising gold in a content between 75% and 75.3%, copper in a content between 15% and 23%, and silver to balance. This invention does not consider palladium as an element capable to increase the resistance against corrosion phenomena, but discloses its use to increase the castability and toughness of the material.

Eventually, document EP1512765A1 (2005) also discloses additions of palladium in amounts of less than 4%, among the various claims. Furthermore, for the same purpose, it also envisages additions of platinum in amounts between 0.5% and 4% to alloys which comprise gold in a content higher than 75% and copper in a content between 6% and 22%, and in which minimal additions of silver, cadmium, chromium, cobalt, iron, indium, manganese, nickel or zinc may be present in an amount of less than 0.5%. These compositions have been developed for the synthesis of rose gold alloys with a high resistance against surface color change under environments in which chlorine compounds may be present.

Several documents (WO2009092920, DE3211703, EP2251444, DE102004050594, DE10027605A1, EP0381994, U.S. Pat. No. 4,820,487) disclose additions of vanadium and other elements such as iron, chromium, zirconium, hafnium, titanium or tantalum to white gold alloys. However, in the documents cited above, such additions are considered only to improve the mechanical features of the claimed compositions or to achieve particular color properties.

DESCRIPTION OF THE INVENTION

The present invention seeks to improve the chemical stability of currently commercially available colored gold alloys. The aim is to increase the tarnishing-resistance of alloys with a minimum content of gold of 75 wt % under environments in which sulphur- or chlorine-compounds are present.

Particularly, the present invention seeks to increase the chemical stability of high-carat colored alloys by providing for the addition of iron and vanadium to the basic gold-silver-copper system. Particularly, the invention discloses alloy compositions containing gold at a concentration higher than 75 wt %, copper at a concentration between 5% and 21%, silver at a concentration between 5% and 21%, iron at a concentration between 0.5% and 4%, and vanadium at a concentration between 0.1% and 2%.

DESCRIPTION OF TABLES AND FIGURES

TABLE 1 shows the composition and the main physical characteristics of the alloys disclosed in the present document. For each composition, the values tabulated in columns $L^*_0$, $a^*_0$, $b^*_0$ are evaluated with the use of a spectrophotometer Konica Minolta CM-3610d. These measurements are performed under reflection conditions with the use of a light source D65-6504K, a di/de observation angle of 8°, and a measurement area of 8 mm (MAV). The measurements are carried out on samples immediately after a careful processing of their surfaces. The surface processing of samples of the various compositions disclosed herein includes smoothing with abrasive papers followed by polishing. Smoothing is performed by means of abrasive papers, whereas polishing is carried out with diamond pastes having a grain size of up to 1 μm. This processing is carried out until a constant reflection factor is reached. Such a processing is essential, and it is carried out in order to remove traces of any compound which can alter the surface composition of the alloy and its actual color, thereby having the potential to distort the experimental measurements. The hardness values shown herein are measured after a flatbed lamination hardening of the material to 70% (column "70% hardened"), after an annealing treatment at 680° C. (column "Annealed"), and after a heat-treatment hardening performed at a temperature of 300° C. (column "Aged"). Hardness tests are carried out with an applied load of 9.8N (HV1) which is maintained for 15 seconds, as specified by standard ISO 6507-1.

Table 2 shows the ΔE(L*,a*,b*) values measured after 150 hours of exposure to thioacetamide vapors (column "Exposure to thioacetamide vapors (150 hrs)") and after 175 hours of immersion in a saturated solution of sodium chloride at neutral pH and at a thermostated temperature of 35° C. (column "Immersion in saturated aqueous NaCl (175 hrs)"). The values shown for parameters ΔE(L*,a*,b*) relate to spectrophotometric measurements of the values of coordinates L*,a*,b* as taken at defined time intervals. The values thus obtained for coordinates CIE 1976 L*a*b* allow the kinetics of surface discoloration of the test sample to be quantified by evaluating the parameter $\Delta E^*(L^*,a^*,b^*)=[(L^*-L^*_0)^2+(a^*-a^*_0)^2+(b^*-b^{*2}_0)]^{1/2}$ over time. This parameter is calculated with respect to the values of coordinates $L^*_0$, $a^*_0$, $b^*_0$ for the test alloy (values shown in table 1).

DETAILED DESCRIPTION OF THE INVENTION

Figure 1:
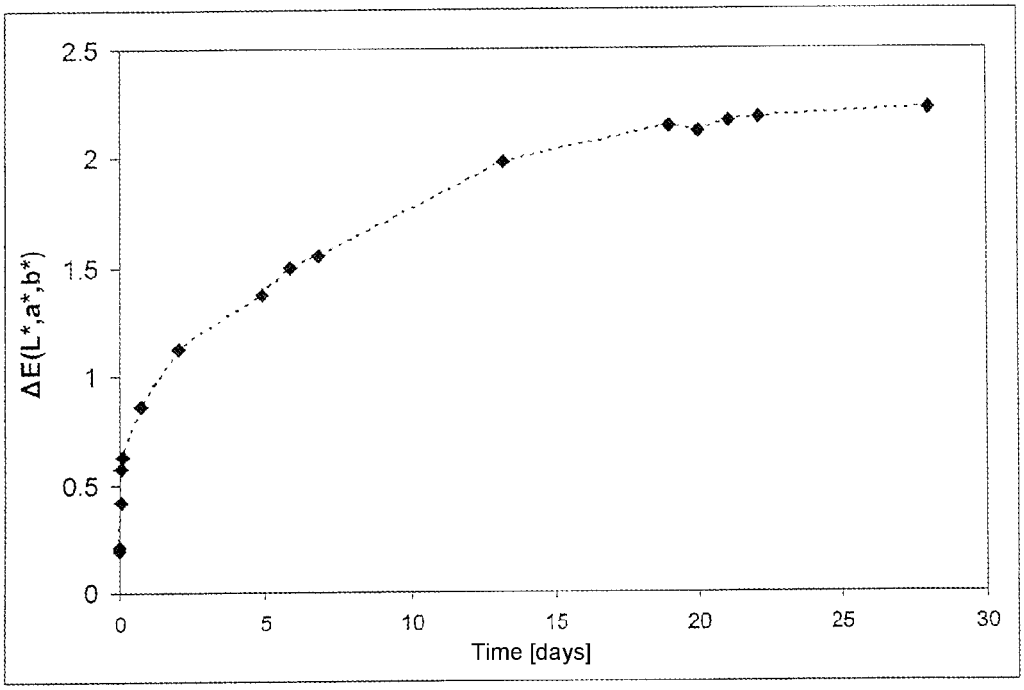
FIG. 1 shows the change in surface color for an alloy 5N ISO 8654 while exposed to a generic ambient atmosphere at 25° C.

The different compositions disclosed in the present invention are melted by using an induction furnace equipped with a graphite crucible, and they are melted in graphite molding boxes of rectangular section. The homogeneity of the bath during melting is ensured by electromagnetic induction stirring. The pure elements (Au 99.999%, Cu 99.999%, Pd 99.95%, Fe 99.99%, Ag 99.99%, V≥99.5%) are melted and cast under a controlled atmosphere. Particularly, melting operations are carried out only after at least 3 cycles of conditioning of the atmosphere of the melting chamber. This conditioning includes reaching a vacuum level up to pressures below $1\times10^{-2}$ mbar, followed by partially saturating the atmosphere with argon to 500 mbars. During melting, argon pressure is maintained at pressure levels in a range from 500 mbars to 800 mbars. When pure elements are completely melted; the liquid is overheated up to a temperature of about 1250° C. in order to homogenize the chemical composition of metal bath. During overheating, a vacuum level of less than $1\times10^{-2}$ mbar is reached again, which is useful to eliminate a portion of the slag produced while the pure elements are being melted. At this point, the melting chamber is partially re-pressurized to 800 mbars with argon, and then the molten material is poured into the graphite molding box. Once solidification has occurred, the resulting melts are extracted from the molding box, quenched in water to prevent phase changes to solid state, and then plastically cold-deformed by flatbed lamination.

During the cold plastic processing process, the different compositions synthesized according to the melting procedure described above are deformed up to 70%, then subjected to a heat annealing treatment at temperatures above 680° C., and subsequently quenched in water to prevent a phase change to solid state. During the entire process, all the compositions shown herein are subjected to hardness testing in the hardened and annealed state. Additional hardness measurements are made after a heat-treatment hardening carried out at a temperature of 300° C. Hardness tests are performed with an applied load of 9.8N (HV1) which is maintained for 15 seconds, as specified by standard ISO 6507-1.

Samples are taken from the materials processed by the processing procedures described above, i.e. after melting, lamination, heat-treatment annealing and subsequent quenching, for metallographic analysis. These samples are smoothed, polished and analyzed in order to evaluate the microstructural properties of the synthesized compositions. Similarly, additional samples of material are taken from the materials processed by the processing procedures described above, and they are subjected to color measurements and accelerated corrosion testing.

The surface of the samples subjected to color measurements and accelerated corrosion testing are carefully smoothed by means of abrasive papers and subsequently polished with diamond pastes with a grain size of up to 1 μm,until the achievement of a constant reflection factor. Such a surface processing of the samples is essential, and it is carried out in order to remove traces of any compound which can alter the surface composition of the alloy and its actual color, thereby distorting the experimental measurements.

Color measurements were made using a spectrophotometer Konica Minolta CM-3610d immediately after the preparation of the samples and during the various corrosion tests. These measurements are carried out under reflection conditions with the use of a light source D65-6504K, a di/de observation angle of 8°, and a measurement area of 8 mm (MAV).

The resistance to surface color change of the different compositions proposed herein is evaluated in accordance with the test procedures prescribed by standard ISO 4538. This standard establishes apparatus and procedure for evaluating the corrosion- and oxidation-resistance of metal surfaces under an atmosphere containing volatile sulphides. To this aim, the specimens are exposed to thioacetamide vapors $CH_3CSNH_2$ under an atmosphere having a relative humidity of 75% which is maintained with the use of a saturated solution of sodium acetate trihydrate $CH_3COONa.3H_2O$.

Furthermore, in order to evaluate the resistance to surface color change under environments characterized by the presence of chlorides, further tests are carried out by immersing the samples in a saturated solution of NaCl at neutral pH and at a thermostated temperature of 35° C.

Color changes occurring in the compositions analyzed by accelerated corrosion testing are a function of the time t of exposure to the aggressive action of test environments. Such changes can be evaluated experimentally by taking spectrophotometric measurements of coordinate values L*,a*,b* from the surface of the test alloy samples at defined time intervals. The values thus obtained for coordinates CIE 1976 L*a*b* allow the kinetics of surface discoloration of the test material to be quantified by evaluating the parameter $\Delta E^*(L^*,a^*,b^*)=[(L^*-L^*_0)^2+(a^*-a^*_0)^2+(b^*-b^*_0{}^2)]^{1/2}$ over time. This parameter must be evaluated with respect to coordinates $L^*_0$, $a^*_0$, $b^*_0$ of the test material as measured immediately after smoothing with abrasive papers and subsequent polishing with diamond pastes with a grain size of up to 1 μm. These operations are carried out until a steady reflection factor is reached. Such a surface processing of the sample is essential, and it is carried out in order to remove traces of any compound which can alter the surface composition of the alloy and its actual color, thereby having the potential to distort the experimental measurements. The results of these tests allow experimental curves ΔE*(L*,a*,b*) vs. time to be obtained, which are indispensable to analyze the kinetics of color change in the analyzed compositions and, therefore, to quantitatively analyze the chemical stability in considered test environments.

Compositions and main physical characteristics of the alloys considered in the present document are shown in table 1. On the contrary, table 2 shows the values of ΔE(L*,a*,b*)

as measured after 150 hours of exposure of the analyzed compositions to thioacetamide vapors, and after 175 hours of immersion of the analyzed compositions in the solution containing sodium chloride.

Additions of iron and vanadium of more than 1% and 0.1 wt % respectively, allow surface color change to be decreased under an atmosphere containing volatile sulphides. In this way, it is not required to add palladium in order to improve the chemical stability of the analyzed compositions, thereby avoiding the decrease of surface brightness due to the presence of this element within the alloy. Similarly, expensive additions of platinum are not required.

Figure 2:
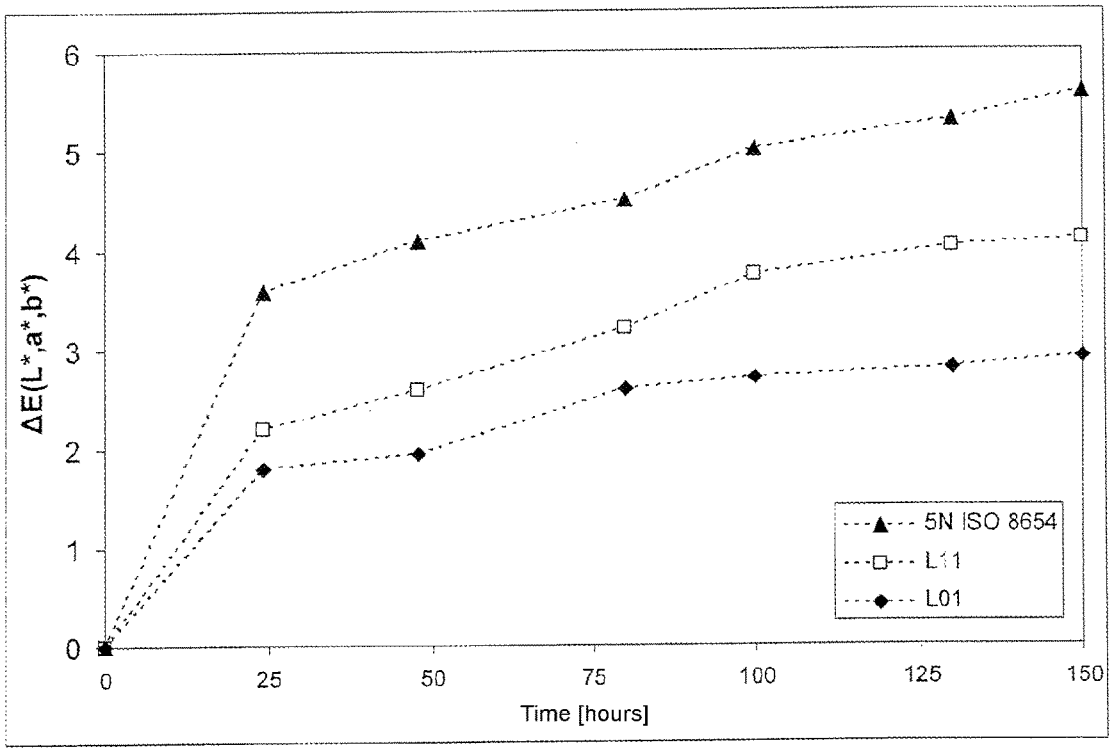
FIG. 2 shows the color changes ΔE(L*,a*,b*) for composition 5N ISO 8654, composition L11 and composition L01 as evaluated while carrying out tests according to standard ISO 4538.

The curves shown in FIG. 2 can then be analyzed. Since time t=0 corresponds to conditions immediately after the polishing of the samples 5N ISO8654, L11, L01, then the value of ΔE*(L*,a*,b*, t=0) for the three different given compositions is zero. As can be seen, after 150 hours of exposure to thioacetamide vapors, for an alloy containing iron in a content of 1.8 wt % and vanadium in a content of 0.4 wt % (L01), color change ΔE(L*,a*,b*) is 2.9. Under the same conditions, an alloy 5N ISO 8654 undergoes a change of 5.6, whereas such a parameter for an alloy (L11) according to document EP1512765A1 has a value of 4.1.

Furthermore, for alloys having a composition falling within this embodiment of the invention, the kinetics of discoloration occurring during testing differs from those of the two compositions taken as a reference. As can be also seen in FIG. 2, with reference to the alloy 5N ISO 8654, a rapid color change occurs within the first 24 hours of the test. Subsequently, the kinetics of color change decreases, but the parameter ΔE(L*,a*,b*) continues to increase throughout the 150 hours of testing analyzed. The alloy L11 also shows a similar behavior, but after about 120 hours of exposure to thioacetamide vapors, the values of parameters ΔE(L*,a*, b*) for this composition reach a plateau of almost constant values. On the contrary, color change for composition L01 is stabilized after only 80 hours of testing.

Again, the presence of iron in the composition of the alloy allows the miscibility of vanadium in gold to be increased. Keeping a ratio greater than 4 between of iron and vanadium levels, allows obtaining solid solutions and preventing second phases from separating out from the mixture.

Figure 3:
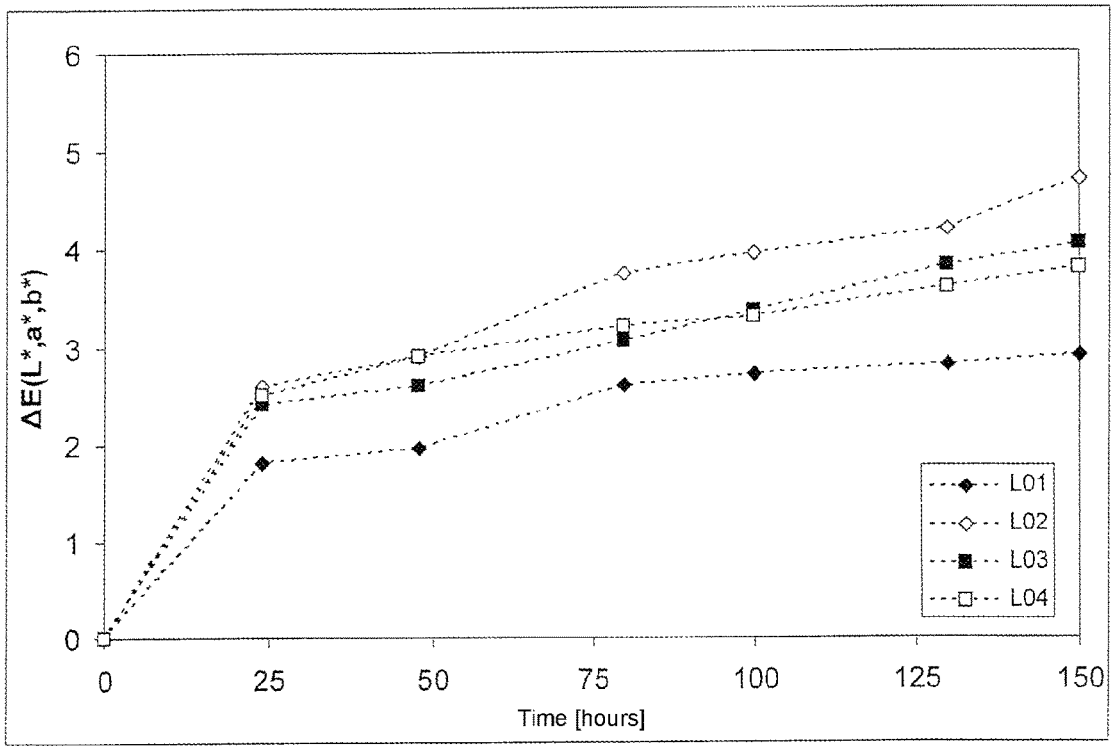
FIG. 3 shows the color changes ΔE(L*,a*,b*) for compositions L01, L02, L03 and L04 as evaluated while carrying out tests according to standard ISO 4538.

The curves shown in FIG. 3 can then be analyzed. Since time t=0 corresponds to the conditions immediately after the polishing of the samples L01, L02, L03, L04, then the value of ΔE*(L*,a*,b*, t=0) for the four different given compositions is zero.<Compositions in which palladium is replaced with iron show a decreased resistance to color change under environments characterized by the presence of volatile sulphides. After 150 hours of exposure to the thioacetamide vapors, an alloy with 1.8 wt % of palladium and 0.4 wt % of vanadium (L03) undergoes a change ΔE(L*,a*,b*) of 4.1, thus showing a surface color change which is comparable to that of the composition L11. However in this case, (FIG. 3), is not possible to observe a stabilization of the parameter ΔE(L*,a*,b*) for the composition L03 within the first 150 hours of testing.

Moreover, the addition of vanadium is essential to increase the chemical stability of considered compositions. Under atmospheres containing volatile sulphides, a simple addition of 1.8 wt % of iron (L02) results in a color change which is completely equivalent to that shown by the reference alloy 5N ISO 8654 (FIG. 3).

If palladium is substituted for iron, the effects generated by the presence of vanadium are less obvious. As also shown in FIG. 3, after 150 hours of exposure to thioacetamide vapors, a composition only characterized by palladium in a content of 1.8 wt % (L04) undergoes a color change ΔE(L*, a*,b*) of 3.8. For a composition in which vanadium is also present, this parameter has a value of 4.1. In this case, the presence of vanadium does not affect the chemical stability of quaternary gold-silver-copper-palladium system. Furthermore, the compositions L03 and L04 are not only characterized by the same chemical stability, but also by the same kinetics of color development throughout the entire test range.

Figure 4:
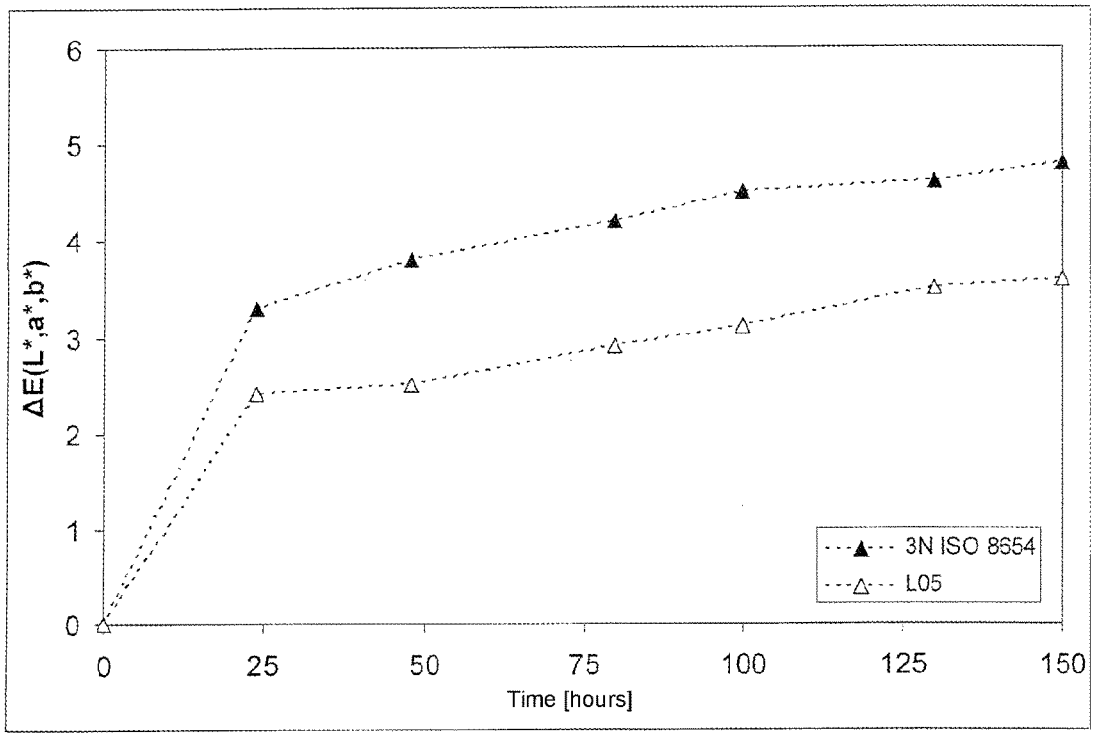
FIG. 4 shows the color changes ΔE(L*,a*,b*) for compositions 3N ISO 8654 and L05 as evaluated while carrying out tests according to standard ISO 4538.

In case in which palladium is present in the alloy in substitution for iron, the effect of vanadium becomes appreciable only after the content of silver is increased and the content of copper is decreased. This is the case of an alloy comprising silver in contents between 5% and 16 wt %, palladium in contents between 0.2% and 5 wt %, and vanadium in contents between 0.2% and 1.5 wt %. The curves shown in FIG. 4 can then be analyzed. Since time t=0 corresponds to the conditions immediately after the polishing of the samples 3N ISO8654, L05, then the value of ΔE*(L*,a*,b*, t=0) for the two different given compositions is zero. For example (FIG. 4), after 150 hours of exposure to the thioacetamide vapors, an alloy comprising silver and copper in contents of 12.5% by weight and additions of palladium and vanadium of 1.8% and 0.4 wt % respectively (L05) shows a color change ΔE(L*,a*,b*) of 3.6. Under the same conditions, a standard alloy 3N ISO 8654 undergoes a change of 4.8. In this particular embodiment of the invention, the additions of palladium allow the miscibility of vanadium in gold to be increased.

Figure 5:
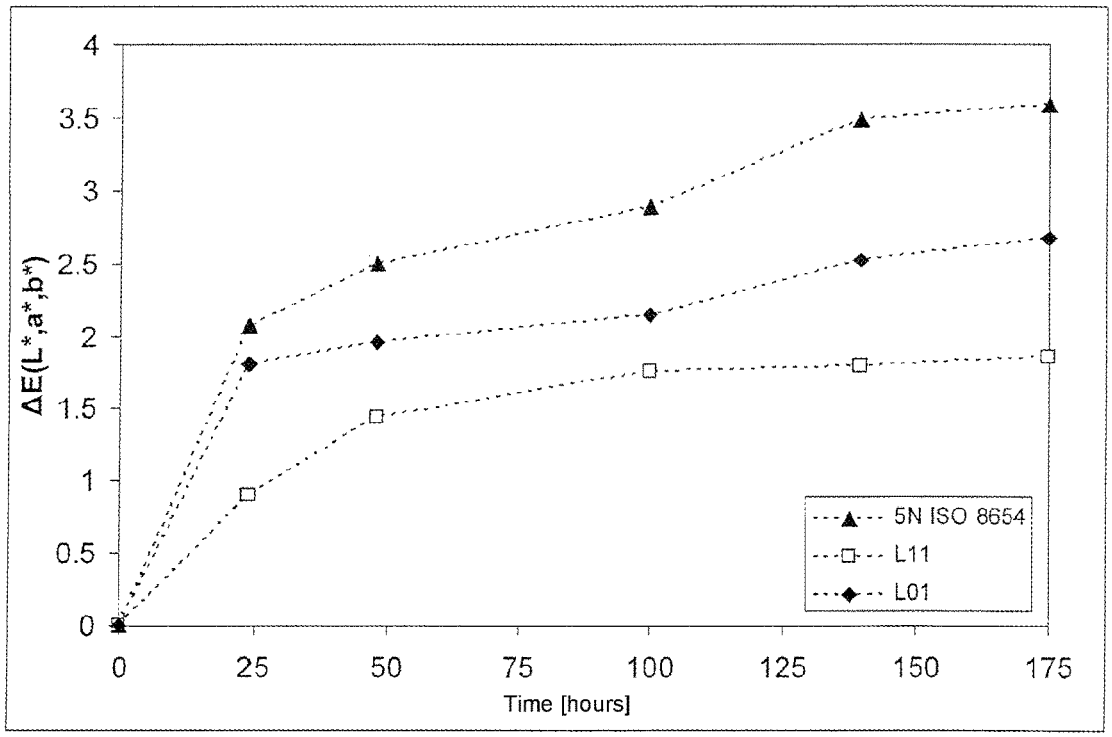
FIG. 5 shows the color changes ΔE(L*,a*,b*) for composition 5N ISO 8654, composition L11 and composition L01 as evaluated while carrying out tests by immersing the various samples in a saturated solution of sodium chloride NaCl at neutral pH and at a thermostated temperature of 35° C.

Tests performed by immersing the samples into the solution of sodium chloride (FIG. 5) confirm the chemical stability of the alloy L11 disclosed in document EP 1512765A1. After 175 hours of immersion in the chloride-containing solution, such a composition undergoes a color change ΔE(L*,a*,b*) of 1.9, while such a parameter for a composition 5N ISO 8654 has a value of 3.6. Under the same conditions, the composition L01 undergoes a change of 2.7. Accordingly, simple additions of iron or vanadium cannot optimize the strength of gold alloys in solutions in which chlorides are dissolved.

To this aim, a further embodiment of the invention provides for additions of palladium in a range from 0.5% to 2 wt %, iron in a range from 0.5% to 2 wt %, and vanadium in a range from 0.1% to 1.5 wt %.

Figure 6:
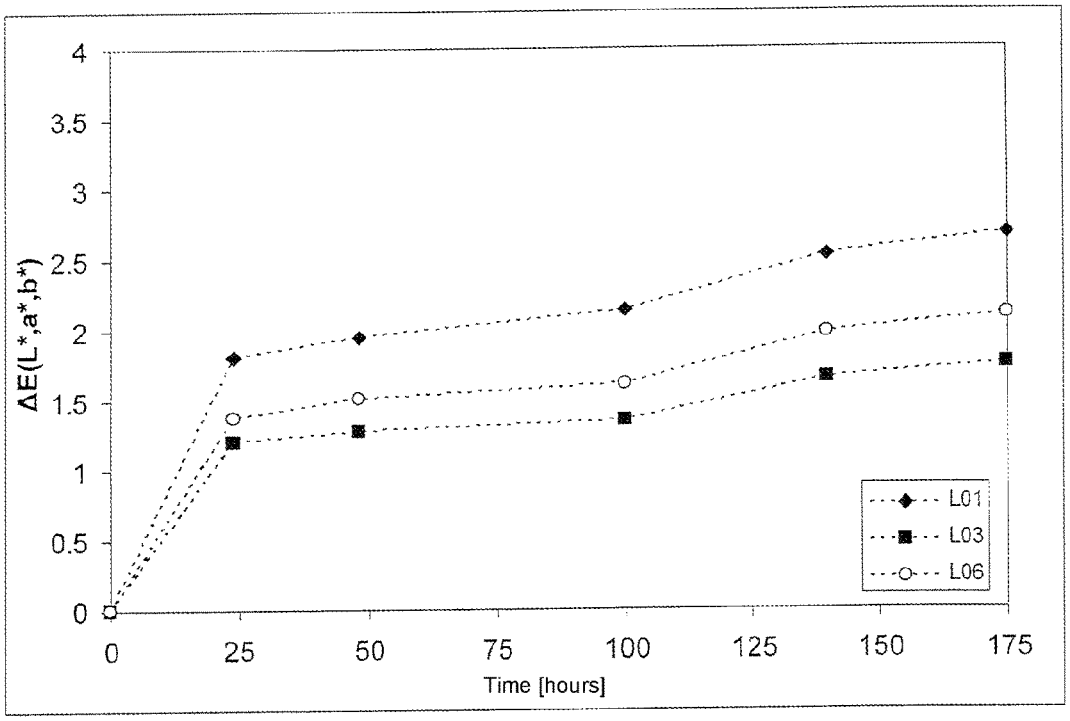
FIG. 6 shows color changes ΔE(L*,a*,b*) for compositions L01, L03 and L06 as evaluated while carrying out tests by immersing the various samples in a saturated solution of sodium chloride NaCl at neutral pH and at a thermostated temperature of 35° C.

After 175 hours of immersion in the chloride-containing solution, an alloy characterized by 0.9 wt % of iron, 0.9 wt % of palladium and 0.4 wt % of vanadium (L06) undergoes a color change ΔE(L*,a*,b*) of 2.1. The curves shown in FIG. 6 can then be analyzed. Since time t=0 corresponds to the conditions immediately after the polishing of the samples L01, L03, L06, then the value of ΔE*(L*,a*,b*, t=0) for the three different given compositions is zero. As can be seen in FIG. 6, the color change of the alloy L11 is quick within the first 48 hours of testing and after about 150 hours of immersion, and the values of the parameter ΔE(L*, a*,b*) reach a plateau of almost constant values. On the contrary, the composition L06 undergoes a rapid color change within the first 24 hours, and similarly to what happens with the composition L11, the parameter ΔE(L*, a*,b*) of the composition L06 is also stabilized after about 150 hours of testing.

Figure 7:
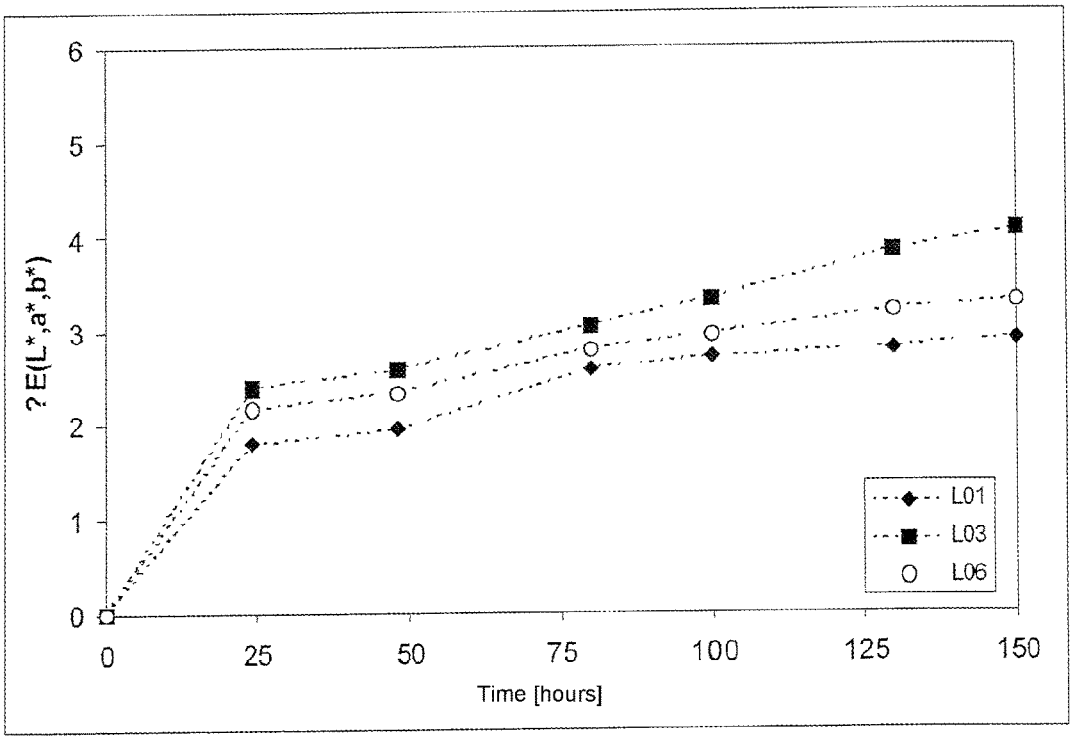
FIG. 7 shows the color changes ΔE(L*,a*,b*) for compositions L01, L03 and L06 as evaluated while carrying out tests according to standard ISO 4538.

This further embodiment of the invention allows the resistance to color change to be increased in solutions in which chlorides are dissolved. However, at the same time, the chemical stability under environments containing volatile sulphides is maintained. The curves shown in FIG. 7 can then be analyzed. Since time t=0 corresponds to the conditions immediately after the polishing of the samples L01, L03, L06, then the value of ΔE*(L*,a*,b*, t=0) for the three different given compositions is zero. As shown in FIG. 7, after 150 hours of exposure to thioacetamide vapors, the composition L06 undergoes a color change ΔE(L*,a*,b*) of 3.3. This color change reaches a plateau of intermediate values compared to those of the compositions L01 and L03.

Furthermore, compositions in which the ratio of the sum of the concentrations of iron and palladium to the concentration of vanadium is greater than 4, are solid solutions which are homogeneous and free of second phases.

By replacing palladium with iron, it is possible to obtain an increased surface brightness. As shown in table 1, the composition L01 is characterized by a parameter L* of 86.66, whereas such a parameter for the composition L04 has values lower than and equal to 85.21. The L* values obtained by partially replacing palladium with iron, as in the case of the composition L06, are intermediate values compared to those set forth above.

Iron and vanadium are chemical elements capable to decrease the shade saturation of gold alloys. The higher the concentration of these elements, the lower the values of coordinates a* and b* and the more the colors will become achromatic.

To overcome this problem, a further embodiment of the invention discloses compositions in which silver may not be present and which comprise copper in a content between 16% and 23 wt %, iron in a content between 0.5% and 4 wt %, and vanadium in a content between 0.1% and 1 wt %. For example, with the composition L07 in which iron is present at a concentration of 2.5 wt % and the content of vanadium is 0.6 wt %, it is possible to obtain an a* value of 6.45 which is similar to that reported for the composition L01. However, the absence of silver causes a decrease in parameter b* (yellow). In fact, the composition L07 is characterized by a b* value of 12.90, whereas this parameter takes a value of 15.49 for the composition L01. Also with this particular embodiment of the invention, which includes compositions in which the ratio between the concentrations of iron and vanadium is more than 4, solid solutions are obtained which are homogeneous and free of second phases.

Moreover, the presence of iron causes an increase in surface brightness. An alloy with 2.5 wt % of palladium (L09) is characterized by an L* value of 83.77. The composition L07 in which iron is present in a content of 2.5 wt % is characterized by an L* value of 86.09. When iron content is increased to 3.1 wt %, even in the absence of vanadium (L08), the parameter L* takes a value of 86.33.

Figure 8:
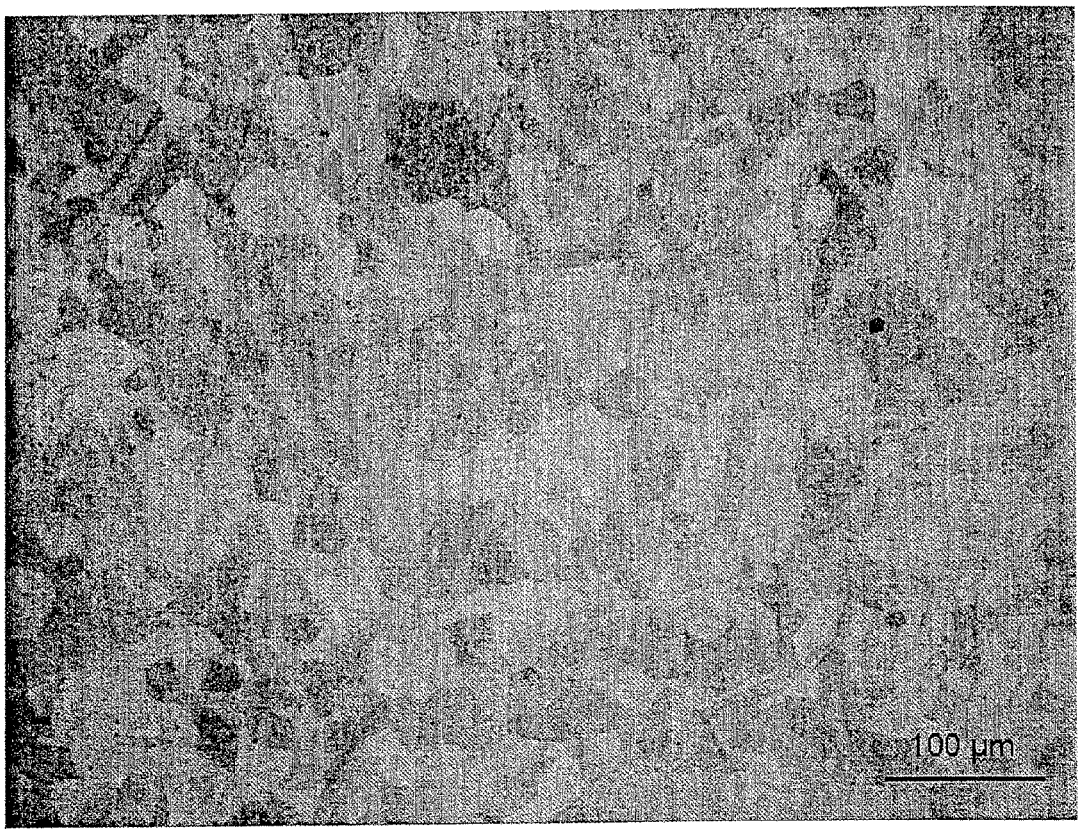
FIG. 8 shows the micro-structure of an alloy comprising iron in a content of 1.8 wt%, vanadium in a content of 0.4 wt%, and iridium in a content of 0.01 wt%.

A last embodiment of the invention may comprise iridium in contents of less than 0.05 wt %. These additions allow the crystal structure of the compositions considered to be tuned. FIG. 8 shows the micro-structure of an alloy comprising iron in a content of 1.8 wt %, vanadium in a content of 0.4 wt %, and iridium in a content of 0.01 wt %, which has been plastically cold-deformed up to 70% and annealed at 680° C. The composition is characterized by a grain size of 7 according to standard ISO 643. A similar grain size allows the manufactured articles to show a good polishing ability. Increased additions of iridium can further increase the grain size index and have adverse effects on the chemical stability of the alloy.

TABLE 1

| | | Color CIE | | | Hardness HV1 | | |
|---|---|---|---|---|---|---|---|
| | | L*a*b* | | | 70% | | |
| Alloy | Composition [wt %] | L*0 | a*0 | b*0 | Hardened | Annealed | Aged |
| L01 | Au75 Ag4.1 Cu18.7 Fe1.8 V0.4 | 86.86 | 6.45 | 15.49 | 267 | 170 | 265 |
| L02 | Au75 Ag4.2 Cu19.0 Fe1.8 | 86.88 | 6.47 | 15.50 | 261 | 162 | 273 |
| L03 | Au75 Ag4.1 Cu18.7 Pd1.8 V0.4 | 85.54 | 7.32 | 14.17 | 256 | 160 | 285 |
| L04 | Au75 Ag4.2 Cu19.0 Pd18 | 85.21 | 8.23 | 14.47 | 254 | 156 | 298 |
| L05 | Au75 Ag11.4 Cu11.4 Pd1.8 V0.4 | 87.27 | 5.16 | 17.30 | 239 | 154 | 215 |
| L06 | Au75 Ag3.6 Cu19.2 Pd0.9 Fe0.9 V0.4 | 85.77 | 6.85 | 14.10 | 273 | 165 | 275 |
| L07 | Au75 Cu21.9 Fe2.5 V0.6 | 86.09 | 6.45 | 12.90 | 295 | 192 | 323 |
| L08 | Au75 Cu21.9 Fe3.1 | 86.33 | 5.78 | 12.75 | 272 | 163 | 302 |
| L09 | Au75 Cu22.5 Pd25 | 83.77 | 8.11 | 11.74 | 245 | 163 | 286 |
| L10 | Au75 Ag4.1 Cu18.7 Fe1.8 V0.4 Ir0.01 | 86.80 | 6.43 | 15.49 | 265 | 172 | 260 |
| L11 | Au76 Pt3 Cu21 | 84.52 | 9.10 | 13.10 | 270 | 165 | 300 |
| 5N ISO 8654 | Au75 Ag4.5 Cu20.5 | 86.94 | 9.60 | 17.50 | 230 | 165 | 325 |
| 3N ISO 8654 | Au75 Ag12.5 Cu12.5 | 89.30 | 5.68 | 22.45 | 220 | 145 | 230 |

TABLE 2

| | | ΔE(L*, a*, b*) | |
|---|---|---|---|
| Alloy | Composition [wt %] | Exposure to thioacetamide vapors (150 hours) | Immersion in a saturated aqueous solution of NaCl (175 hours) |
| L01 | Au75 Ag4.1 Cu18.7 Fe1.8 V0.4 | 2.9 | 2.7 |
| L02 | Au75 Ag4.2 Cu19.0 Fe1.8 | 4.7 | 2.9 |
| L03 | Au75 Ag4.1 Cu18.7 Pd1.8 V0.4 | 4.1 | 1.8 |
| L04 | Au75 Ag4.2 Cu19.0 Pd18 | 3.3 | 2.4 |
| L05 | Au75 Ag11.4 Cu11.4 Pd1.8 V0.4 | 3.6 | 2.0 |
| L06 | Au75 Ag3.6 Cu19.2 Pd0.9 Fe0.9 V0.4 | 3.3 | 2.1 |
| L07 | Au75 Cu21.9 Fe2.5 V0.6 | 4.2 | 2.6 |
| L08 | Au75 Cu21.9 Fe3.1 | 4.4 | 3.0 |
| L09 | Au75 Cu22.5 Pd25 | 4.7 | 2.0 |
| L11 | Au76 Pt3 Cu21 | 4.1 | 1.9 |
| 5N ISO 8654 | Au75 Ag4.5 Cu20.5 | 5.6 | 3.6 |
| 3N ISO 8654 | Au75 Ag12.5 Cu12.5 | 4.8 | 3.3 |

The invention claimed is:

1. A tarnish resistant gold alloy for manufacturing jewels or clock components, consisting of:

gold at a concentration of 75 percent by weight (wt %), copper at a concentration of 18.7 wt %, silver at a concentration of 4.1 wt %,
iron at a concentration of 1.8 wt %, and
vanadium at a concentration of 0.4 wt %.

2. A tarnish resistant gold alloy for manufacturing jewels or clock components, consisting of:
gold at a concentration of 75 percent by weight (wt %),
copper at a concentration of 19.2 wt %,
silver at a concentration of 3.6 wt %,
palladium at a concentration of 0.9 wt %,
iron at a concentration of 0.9 wt %, and
vanadium at a concentration of 0.4 wt %.

3. A tarnish resistant gold alloy for manufacturing jewels or clock components, consisting of:
gold at a concentration of 75 percent by weight (wt %),
copper at a concentration of 19 wt %,
silver at a concentration of 4.2 wt %, and
palladium at a concentration of 1.8 wt %.

* * * * *